US009926682B2

(12) United States Patent
Arai et al.

(10) Patent No.: US 9,926,682 B2
(45) Date of Patent: Mar. 27, 2018

(54) DOOR STRUCTURE FOR FLOATING FLAP GATE

(75) Inventors: Hiroaki Arai, Osaka (JP); Hideyuki Niizato, Osaka (JP); Koji Kitamura, Osaka (JP); Jun Okada, Osaka (JP); Satoshi Ashida, Osaka (JP); Kyouichi Nakayasu, Osaka (JP); Yoshito Yamakawa, Osaka (JP)

(73) Assignee: HITACHI ZOSEN CORPORATION, Osaka-Shi, Osaka (JP)

( * ) Notice: Subject to any disclaimer, the term of this patent is extended or adjusted under 35 U.S.C. 154(b) by 146 days.

(21) Appl. No.: 14/239,239

(22) PCT Filed: Jun. 5, 2012

(86) PCT No.: PCT/JP2012/064451

§ 371 (c)(1),
(2), (4) Date: Feb. 17, 2014

(87) PCT Pub. No.: WO2013/027461

PCT Pub. Date: Feb. 28, 2013

(65) Prior Publication Data

US 2014/0193202 A1 Jul. 10, 2014

(30) Foreign Application Priority Data

Aug. 24, 2011 (JP) ..... 2011-182750

(51) Int. Cl.
*E02B 7/46* (2006.01)
*E02B 7/00* (2006.01)
(Continued)

(52) U.S. Cl.
CPC ..... *E02B 7/40* (2013.01); *E06B 5/003* (2013.01); *E02B 3/102* (2013.01); *E06B 3/38* (2013.01); *E06B 2009/007* (2013.01)

(58) Field of Classification Search
CPC ..... E02B 7/44; E02B 15/0835; E02B 3/104; E02B 7/28; E02B 7/40; E02B 15/0885; E02B 7/50; E02B 9/027
(Continued)

(56) References Cited

U.S. PATENT DOCUMENTS 2,014,548 A * 9/1935 Becher ..... E02B 7/40 405/100
2,045,824 A * 6/1936 Becher ..... E02B 7/54 405/87
(Continued)

FOREIGN PATENT DOCUMENTS

JP 2002-155666 A 5/2002
JP 2006-299574 A 11/2006
(Continued)

OTHER PUBLICATIONS

International Search Report for International Application No. PCT/JP2012/064451, dated Jul. 31, 2012, 1 page.
(Continued)

*Primary Examiner* — Benjamin Fiorello
*Assistant Examiner* — Edwin Toledo-Duran
(74) *Attorney, Agent, or Firm* — Brinks Gilson & Lione

(57) ABSTRACT

To make it possible to raise a door body even if it is damaged by an impact of vehicle traffic or falling objects when it is in a lowered state, and to keep the door body in a raised state even if it is damaged by a water pressure of a tsunami or a high tide when it is in a raised state. A door body 2 of a floating flap gate 1 is disposed at an opening or at an access way. When water flows in, a forward end 2*b* of which swings upwards, in a direction in which the water flows in and within a plane in a height direction, around a base end 2*a* thereof which serves as a center of rotation, to block the
(Continued)

opening or the access way. The door body 2 is formed from a hard polyurethane foam 4 in the form of a sheet.

4 Claims, 4 Drawing Sheets

(51) Int. Cl.

| | |
|---|---|
| ***E02B 7/40*** | (2006.01) |
| ***E06B 5/00*** | (2006.01) |
| *E02B 3/10* | (2006.01) |
| *E06B 9/00* | (2006.01) |
| *E06B 3/38* | (2006.01) |

(58) Field of Classification Search
USPC ..... 405/63, 70, 71, 85, 87, 90, 92, 94, 99, 405/100, 101, 102, 103, 104, 105, 106
See application file for complete search history.

(56) References Cited

U.S. PATENT DOCUMENTS 3,614,844 A * 10/1971 Withers ..... E06B 11/00 256/10
3,935,711 A * 2/1976 Sawai ..... E02B 7/44 405/100
5,468,090 A * 11/1995 Brombach ..... E02B 7/005 405/100
5,472,293 A * 12/1995 Roller ..... E02B 8/045 405/87
5,473,849 A * 12/1995 Jones, Jr. ..... B32B 13/02 249/42
5,516,230 A * 5/1996 Bargeron ..... E02B 7/205 405/100
5,605,413 A * 2/1997 Brown ..... E01F 15/025 256/13.1
6,276,097 B1 * 8/2001 Whitley ..... E04G 23/0218 249/20
6,588,979 B1 * 7/2003 Pasij ..... E02B 3/106 256/31
8,695,947 B2 * 4/2014 Bishop ..... B63B 35/00 114/240 R
2003/0082007 A1 * 5/2003 Liou ..... E06B 9/00 405/87
2003/0143027 A1 * 7/2003 Obermeyer ..... E02B 3/102 405/115
2012/0005960 A1 * 1/2012 Tseng ..... E06B 9/0638 49/31

FOREIGN PATENT DOCUMENTS

JP 4134242 B2 8/2008
JP 4388494 B2 12/2009
KR 10-2009-0114636 A 11/2009

OTHER PUBLICATIONS

International Preliminary Report on Patentability for International Application No. PCT/JP2012/064451, dated Feb. 25, 2014, 6 pages.

* cited by examiner (a)

(b)

(a)

(b)

DOOR STRUCTURE FOR FLOATING FLAP GATE

This application is a 371 application of PCT/JP2012/064451 having an international filing date of Jun. 5, 2012, which claims priority to JP2011-182750 filed Aug. 24, 2011, the entire contents of which are incorporated herein by reference.

TECHNICAL FIELD

The present invention relates to a structure of a door in a floating flap gate which blocks an opening by causing the door body to rise to prevent a rising water from flowing into a public space, for example, at a time of rising water such as a tsunami or a high tide.

BACKGROUND ART

In Patent Reference 1, for example, there is disclosed a tide gate apparatus which opens or blocks an opening of a lock gate installed in a seawall or embankment on a seacoast or near a mouth of a river.

In the tide gate apparatus of the lock gate according to Patent Reference 1, a door body is raised to prevent seawater from flowing into an opening of the lock gate, by causing a bypass circuit of a hydraulic device to open, which causes the tide gate to rise due to a water pressure and a buoyancy of the seawater.

However, in the tide gate apparatus of the lock gate according to Patent Reference 1, if the lock gate is damaged by a wheel load of a vehicle traveling above the lock gate when it is in a lowered state, there is a problem that the lock gate cannot float when water flows into an inner part of the lock gate from the damaged portion.

Moreover, if the lock gate is damaged by a water pressure of a tsunami or a high tide when it is in a raised state, there is a problem that it becomes impossible to maintain the raised state when water flows into an inner part of the lock gate from the damaged portion.

Patent Reference 1: Japanese Patent No. 4,388,494

SUMMARY OF THE INVENTION

Problems to be Solved by the Invention

The problem which the present invention aims to solve is that a conventional tide gate apparatus cannot be raised by a buoyancy if it is damaged by a wheel load of a vehicle traveling above the lock gate when it is in a lowered state, and water flows into an inner part of the lock gate from the damaged portion. There is also a problem that if the lock gate is damaged by a water pressure of a tsunami or a high tide when it is in a raised state, it becomes impossible to maintain the raised state when water flows into an inner part of the lock gate from the damaged portion.

Means for Solving this Problem

The present invention was devised with the aim of solving the above problems by providing a door structure which can rise even if the door body is damaged by an impact of passing vehicles or by a falling object when the door body is in a lowered state, and which is capable of maintaining a raised state even if the door body is damaged by a water pressure of a tsunami or a high tide when it is in a raised state.

The door structure for a floating flap gate according to the present invention has a door body of a floating flap gate which is disposed at an opening or at an access way, so as to block the opening or the access way when water flows in, and comprises being formed from a hard polyurethane foam in the form of a sheet, a forward end of which swings upwards, in a direction in which the water flows in and within a plane in a height direction, around a base end thereof which serves as a center of rotation.

Because the present invention is formed from a hard polyurethane foam in the form of a sheet, the door body is able to rise even if it is damaged by an impact of a passing vehicle or by a falling object when it is in a lowered state. Moreover, the door body is able to maintain a raised state even if it is damaged when it is in a raised state by a water pressure of a tsunami or a high tide.

Advantageous Effects of the Invention

The present invention can be designed to be light in weight, because the door body is formed from a hard polyurethane foam in the form of a sheet. Moreover, the door body can be raised without a sudden decrease in buoyancy, even if the hard polyurethane foam in the form of a sheet is damaged by a wheel load of a vehicle traveling above the door body when it is in a lowered state, because the buoyancy required for raising it is generated by the hard polyurethane foam in the form of a sheet. In addition, the raised state of the door body can be maintained without dropping, even if the hard polyurethane foam in the form of a sheet is damaged by a water pressure of a tsunami or a high tide.

BRIEF DESCRIPTION OF THE DRAWINGS

FIG. 1 (*a*) is a side view, and FIG. 1 (*b*) is a view of FIG. 1 (*a*) as seen from the left-hand side.

FIG. 5 (*a*) illustrates a first process. FIG. 5 (*b*) illustrates a second process.

DETAILED DESCRIPTION OF THE PREFERRED EMBODIMENT

According to the present invention, the object of providing a door structure such that the door can be raised even if it is damaged by an impact of passing vehicles or by a falling object when it is in a lowered state, and such that the door can be maintained in a raised state even if it is damaged by a water pressure of a tsunami or a high tide when it is in a raised state, was achieved by forming the door from a hard polyurethane foam in the form of a sheet.

EXAMPLES

The present invention is described below using FIG. 1 to FIG. 7.

Figure 1:
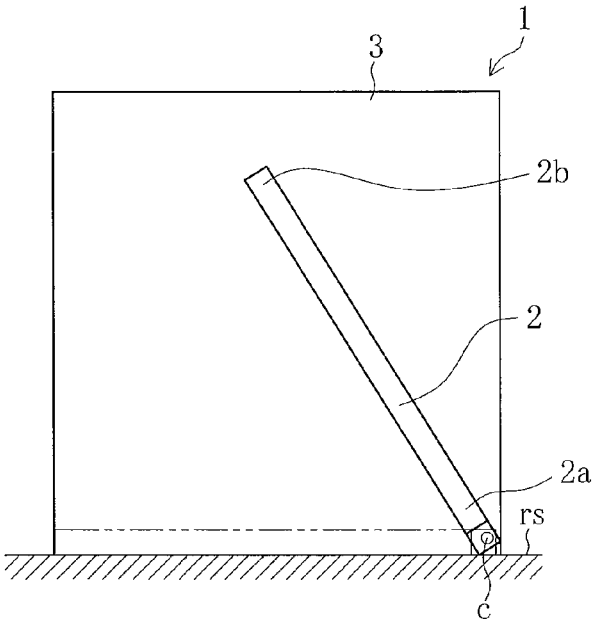
FIG. 1 is a schematic structural drawing of a floating flap gate having the door structure according to the present invention.
Figure 1:
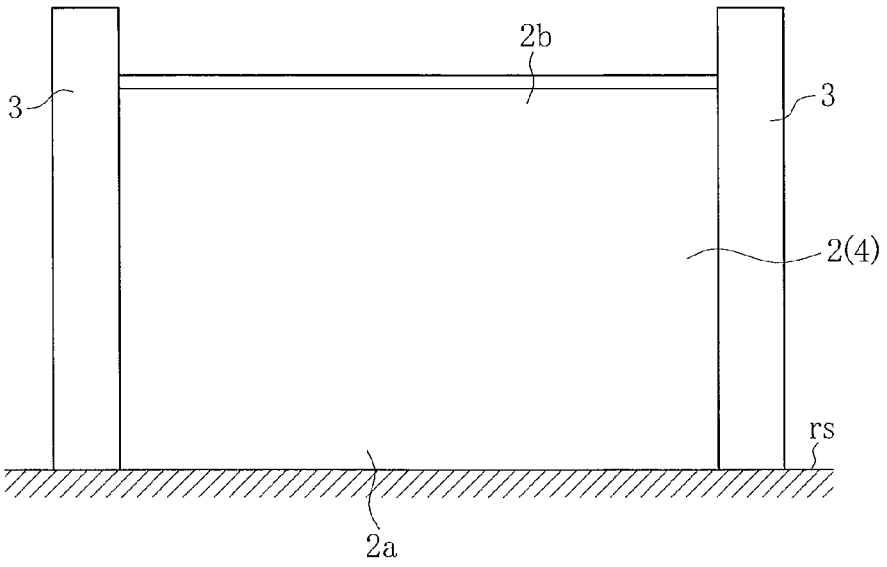

FIGS. 1 (*a*) and (*b*) are schematic structural drawings of a floating flap gate having the door body structure according to the present invention.

In FIG. 1, Reference Numeral 1 is a floating flap gate according to the present invention which is disposed on a channel surface rs at an opening in a seawall, for example, and is formed such that when a door body 2 rises, both sides of the door body 2 and a side door bumper 3 provided at the opening of the seawall are kept in a water-tight state.

When a water tries to flow from an ocean (or from a river) into a public space, for example, the floating flap gate 1 uses the pressure of the water to swing a forward end 2*b* of the door body 2 upwards around a base end 2*a* as a center of rotation c, to water-tightly block the opening.

The floating flap gate 1 according to the present invention comprises a door body 2 with a forward end 2*b* which swings upwards around a base end 2*a* as a center of rotation c, and which is formed from a hard polyurethane foam 4 in the form of a sheet.

The floating flap gate 1 according to the present invention can be designed to be light in weight, because the door body 2 is formed from a hard polyurethane foam 4 in the form of a sheet. Moreover, the door body 2 can be raised without a sudden decrease in buoyancy, even if the hard polyurethane foam 4 in the form of a sheet is damaged by a wheel load of a vehicle traveling above the door body 2 when it is in a lowered state, because the buoyancy required for rising is generated by the hard polyurethane foam 4 in the form of a sheet. In addition, the raised state of the door body 2 can be maintained without dropping, even if the hard polyurethane foam 4 in the form of a sheet is damaged by a water pressure of a tsunami or a high tide.

It is desirable for a density of the hard polyurethane foam 4 which forms the door body 2 to be 0.15-0.4 g/cm$^3$.

If the density of the hard polyurethane foam 4 is less than 0.15 g/cm$^3$, the ability to withstand a wheel load of a vehicle or a forklift traveling above the door body 2 when it is in a lowered state is not sufficient. That is to say, if the mechanical characteristics of the hard polyurethane foam 4 are considered, the density of the hard polyurethane foam 4 used in the flap gate must be 0.15 g/cm$^3$ or higher.

Moreover, although the hard polyurethane foam by itself is light, if it is combined with a metal plate such as described below, the weight of the door body as a whole becomes excessive, making it difficult for the door body 2 to float. It is therefore advantageous that the density of the hard polyurethane foam 4 does not exceed 0.4 g/cm$^3$.

Figure 2:
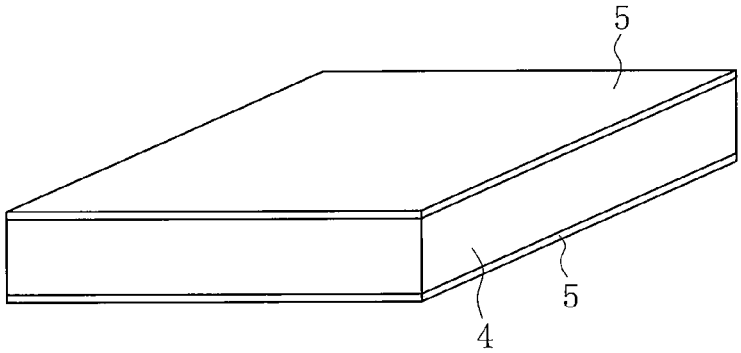
FIG. 2 is a perspective view illustrating a second example of the door structure for the floating flap gate of the present invention.

As shown in FIG. 1, the door body 2 may be formed using only the hard polyurethane foam 4 in the form of a sheet, but a metal plate 5 may be attached to the top and bottom surfaces of the hard polyurethane foam 4 in the form of a sheet with an adhesive, as shown in FIG. 2, for example.

Figure 3:
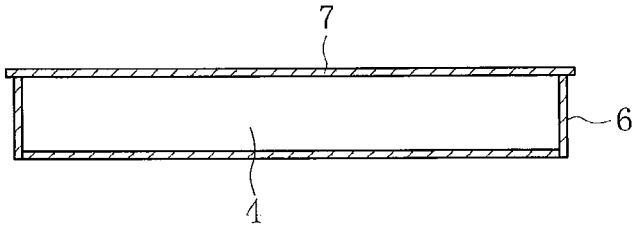
FIG. 3 is a sectional view illustrating a third example of the door structure for the floating flap gate of the present invention.

In addition, not only may a metal plate 5 be attached to the top and bottom surfaces of the hard polyurethane foam 4 in the form of a sheet, but also, as shown in FIG. 3, a metal cover 7 may be attached with an adhesive to a metal box 6 which accommodates the hard polyurethane foam 4 in the form of a sheet, so that all surfaces of the hard polyurethane foam 4 in the form of a sheet are covered with metal.

Such a structure is able to prevent damage to the hard polyurethane foam 4 due to an impact of passing vehicles or falling objects when it is in a lowered state, or from water pressure of a tsunami or a high tide when it is in a raised state.

If there is a wide opening to be blocked, then it is difficult to fabricate the hard polyurethane foam 4 in the form of a sheet so that it will accommodate the width of the opening. Therefore, in cases where the opening is wide, door bodies 2 of a predetermined width are to be linked width-wise at the opening.

However, it is difficult to link to each other by welding, adhesion, or the like, the door bodies 2 which are formed only from the hard polyurethane foam 4, and there is a risk of water leaking from a gap between the door bodies 2. However, if a metal frame member 8 is attached to both sides of the door bodies 2 by a continuous welding, it is possible to prevent water from leaking from a gap between the door bodies 2.

Figure 4:
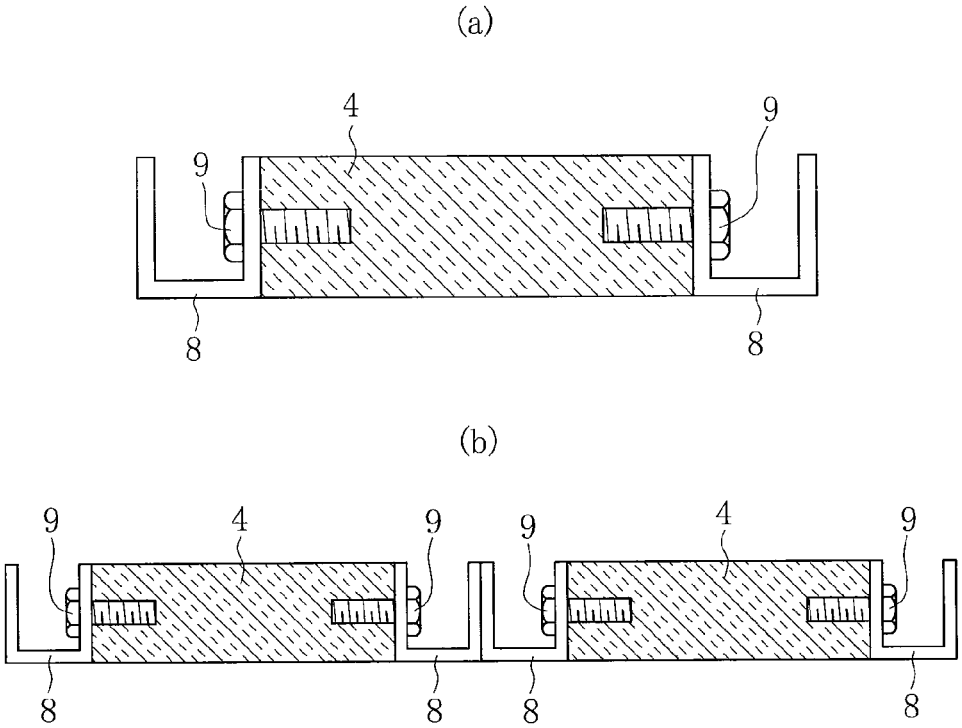
FIG. 4 (*a*) is a sectional view illustrating a fourth example of the door structure for the floating flap gate of the present invention, as seen from the forward end, and FIG. 4 (*b*) is a drawing of two of the fourth examples linked together.

A bolt 9 can be used as a means for attaching the metal frame member 8 to both sides of the door bodies 2 formed from the hard polyurethane foam 4 in the form of a sheet, as shown in FIGS. 4 (*a*) and (*b*).

The following two methods can be used for using the bolt 9 to attach the metal frame member 8 to both sides of the hard polyurethane foam 4 in the form of a sheet.

Figure 5:
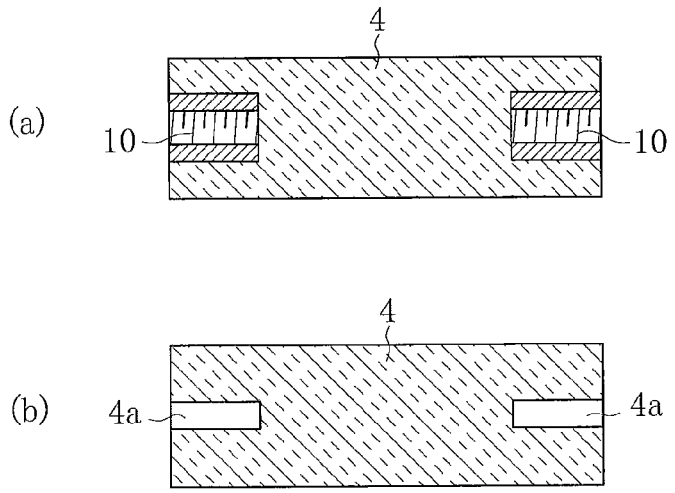
FIG. 5 is a drawing illustrating a process for producing the fourth example of the door structure for the floating flap gate of the present invention.

1) As shown in FIG. 5 (*a*), a female screw 10 is embedded when molding the hard polyurethane foam, after which the bolt 9 is screwed into the female screw 10, thereby attaching the metal frame member 8 to both sides of the hard polyurethane foam 4 in the form of a sheet forming the door body 2.

2) As shown in FIG. 5 (*b*), after molding the hard polyurethane foam 4, a hole 4*a* is formed for insertion of a bolt, and then the bolt 9 is driven into the hole 4*a* to serve as an anchor, so as to attach the metal frame member 8 to both sides of the hard polyurethane foam 4 in the form of a sheet forming the door body 2.

Figure 6:
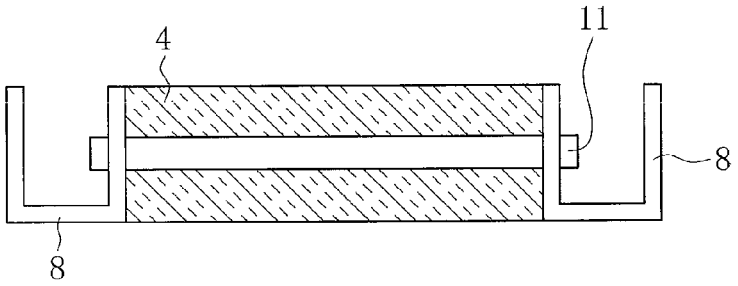
FIG. 6 (*a*) is a sectional view illustrating a fifth example of the door structure for the floating flap gate of the present invention, as seen from the forward end, and FIG. 6 (*b*) is a drawing of two of the fifth examples linked together.
Figure 6:
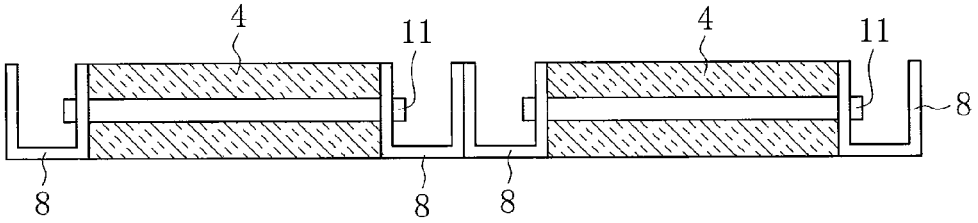

Instead of attaching the metal frame member 8 with the bolt 9, it may be attached using a rod 11, as shown in FIGS. 6 (*a*) and (*b*). The rod 11 may be round or rectangular.

Attachment of the metal frame member 8 to both sides of the hard polyurethane foam 4 in the form of a sheet with a rod 11 may be carried out as follows.

Figure 7:
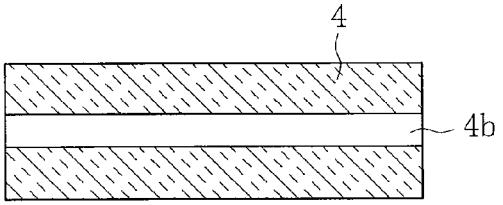
FIG. 7 is a drawing illustrating a process for producing the fifth example of the door structure for the floating flap gate of the present invention.

For example, as shown in FIG. 7, after molding the hard polyurethane foam 4, a through-hole 4*b* is formed for inserting the rod 11, and subsequently, the metal frame member 8 is joined to both sides of the hard polyurethane foam 4 in the form of a sheet forming the door body 2, by means of the rod 11 inserted into the through-hole 4*b*.

Such a structure makes it possible to link a suitable number of door bodies 2 in a width-wise direction, depending on the width of the opening.

The present invention is not limited to the above-described example, and the preferred embodiment may, of course, be advantageously modified within the scope of the technical ideas recited in the claims.

For example, in the example illustrated in FIG. 2, the metal plate 5 is attached to both sides of the hard polyurethane foam 4 in the form of a sheet, but the metal plate 5 may be attached to one side, i.e., either the front or the back, of hard polyurethane foam 4 in the form of a sheet.

In the example illustrated in FIG. 3, the metal cover 7 is attached to the metal box 6 which accommodates the hard polyurethane foam 4 in the form of a sheet, but the metal plate 5 may be attached over the entire surface of the hard polyurethane foam 4 in the form of a sheet.

The invention claimed is:

1. A door structure for a floating flap gate comprising:

a door body of a floating flap gate, having a width, a height and a thickness which defines all surfaces covering the door body, the flap gate is disposed in front of an entrance of an access way to keep water from flowing into the access way, which the entrance of the access way is confined between two vertical walls width-wise, wherein the door body having a water facing front surface and an access way facing back surface, wherein height-wise to the door body, a top end of the door body being a forward end which swings to open or to close while a bottom end of the door body being a stationary base end which serves as a center of rotation, such that the forward end swings upwards to close in a same direction of rising water level which water contacts the front surface of the body, wherein the door body is formed from linking at least two individual adjacent sections adjoined together, wherein each of the individual sections is formed by a hard polyurethane foam in the form of a sheet conforming to a portion of the width, a portion of the height and the thickness, wherein respective metal frames are attached on both opposite side surfaces width-wise to each of the individual sections, having bored through the respective metal frames and the hard polyurethane foam, a plurality of respective through holes from side to side on both opposite side surfaces width-wise in each of the individual sections, wherein a metal plate is attached to overlay entirely both a front surface and a back surface of each of the individual sections of the door body such that the sheet of hard polyurethane foam of each of the individual sections is fully sealed and encapsulated on all the surfaces, or wherein the sheet of hard polyurethane foam of each of the individual sections is fully sealed and encapsulated within an enclosed metal box, and wherein the sheet of hard polyurethane foam in each of the individual sections is held in place to the respective metal frames by securing a plurality of individual through rod sections which are inserted through the respective through holes width-wise within the sheet of hard polyurethane foam onto the respective metal frames on the opposite side surfaces, and the individual adjacent sections are linked together to form the door body through welding a seam adjoining the individual adjacent sections.

2. The door structure for a floating flap gate according to claim 1, wherein a density of the hard polyurethane foam in the form of a sheet is 0.15-0.4 g/cm$^3$.

3. The door structure for a floating flap gate according to claim 1, wherein a metal plate is attached to one of or both of the front surface or the back surface of the door body, which is formed from the sheet of hard polyurethane foam.

4. The door structure for a floating flap gate according to claim 1, wherein a plurality of hard planar polyurethane forms are connected to each other by connections between metal frame members attached to the plurality of hard planar polyurethane forms.

* * * * *